US009289977B2

(12) United States Patent
Van Brocklin

(10) Patent No.: US 9,289,977 B2
(45) Date of Patent: Mar. 22, 2016

(54) BIAS CURRENT REDUCTION FOR PRINT NOZZLE AMPLIFIER

(75) Inventor: Andrew Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,770

(22) PCT Filed: Apr. 25, 2012

(86) PCT No.: PCT/US2012/034941

§ 371 (c)(1), (2), (4) Date: Jul. 25, 2014

(87) PCT Pub. No.: WO2013/162541

PCT Pub. Date: Oct. 31, 2013

(65) Prior Publication Data

US 2015/0042708 A1 Feb. 12, 2015

(51) Int. Cl.
*B41J 2/00* (2006.01)
*B41J 2/045* (2006.01)

(52) U.S. Cl.
CPC ..... *B41J 2/04541* (2013.01); *B41J 2/0452* (2013.01); *B41J 2/04581* (2013.01)

(58) Field of Classification Search
CPC ..... B41J 2/04581; B41J 2/04588; B41J 2/04541; B41J 2/04593; B41J 2/0458
USPC ..... 347/10
See application file for complete search history.

(56) References Cited

U.S. PATENT DOCUMENTS

| | | | | |
|---|---|---|---|---|
| 5,327,029 | A * | 7/1994 | Ericson et al. | 327/350 |
| 5,721,548 | A * | 2/1998 | Choe et al. | 341/118 |
| 6,454,377 | B1 | 9/2002 | Ishizaki | |
| 7,032,986 | B2 | 4/2006 | Corrigan | |
| 7,347,533 | B2 | 3/2008 | Elrod et al. | |
| 2008/0018683 | A1 | 1/2008 | Oshima et al. | |
| 2008/0048763 | A1 * | 2/2008 | Kawano | 327/535 |
| 2009/0066415 | A1 * | 3/2009 | Kim | 330/253 |
| 2009/0244133 | A1 * | 10/2009 | Ootsuka | 347/10 |
| 2010/0007704 | A1 | 1/2010 | Nitta | |
| 2010/0118078 | A1 | 5/2010 | Oshima et al. | |

FOREIGN PATENT DOCUMENTS

| | | |
|---|---|---|
| EP | 1029675 | 8/2000 |
| EP | 1238804 | 9/2002 |

(Continued)

OTHER PUBLICATIONS

Przyborowski, et al. "A 10-Bit Low-Power Small-Area High-Swing CMOS DAC"; http://ieeexplore.ieee.org//xpls/abs_all.jsp?arnumber=5410001; pp. 292-299, vol. 57, Issue 1.

(Continued)

*Primary Examiner* — Manish S Shah
*Assistant Examiner* — Yaovi Ameh
(74) *Attorney, Agent, or Firm* — Tarolli, Sundheim, Covell & Tummino L.L.P.

(57) ABSTRACT

An apparatus includes an amplifier that employs a bias current to drive a print nozzle. A current reduction module can be employed to offset the bias current and to reduce a portion of the bias current from appearing in a subsequent stage to the amplifier in order to mitigate power in the subsequent stage.

9 Claims, 6 Drawing Sheets

(56) References Cited

FOREIGN PATENT DOCUMENTS

| | | | |
|---|---|---|---|
| JP | 2001038892 | A | 2/2001 |
| JP | 2003072063 | A2 | 3/2003 |

OTHER PUBLICATIONS

International Search Report for corresponding PCT/US2012/034941, filed Apr. 25, 2012, completed Feb. 12, 2013 by Jin Ho Park of the KIPO.

* cited by examiner

BIAS CURRENT REDUCTION FOR PRINT NOZZLE AMPLIFIER

RELATED APPLICATIONS

The present invention is a U.S. National Stage under 35 USC 371 patent application, claiming priority to Serial No. PCT/US2012/034941, filed on 25 Apr. 2012, the entirety of which is incorporated herein by reference.

BACKGROUND

Print heads employ nozzles to dispense ink when commanded by electronic circuits such as operational amplifiers. One style of print head is a piezo head where voltages applied by the amplifiers to the piezo element of the print head cause ink to dispense from the head and associated nozzle. Current commercial piezo heads have drivers that use a cold switch circuit where there is a high power, high voltage operational amplifier that is located separately from the print head area, and connected typically by a single wire to the print head. This wire carries the waveform that all ink dispensing nozzles utilize. Another type of piezo head driver utilizes a per nozzle strategy to drive individual print nozzles, wherein each piezo nozzle is driven from a separate print driver circuit. In such cases, currents such as amplifier bias current and current that is generated due to the slew rate of the amplifier can be considerable since each of the respective currents in each circuit is multiplied by the number of driver circuits required to drive the associated print heads. In some cases, hundreds of print heads may be driven by hundreds of driver circuits, wherein the bias and slew rate currents can contribute to considerable power losses when considered in the aggregate.

DETAILED DESCRIPTION

Figure 1:
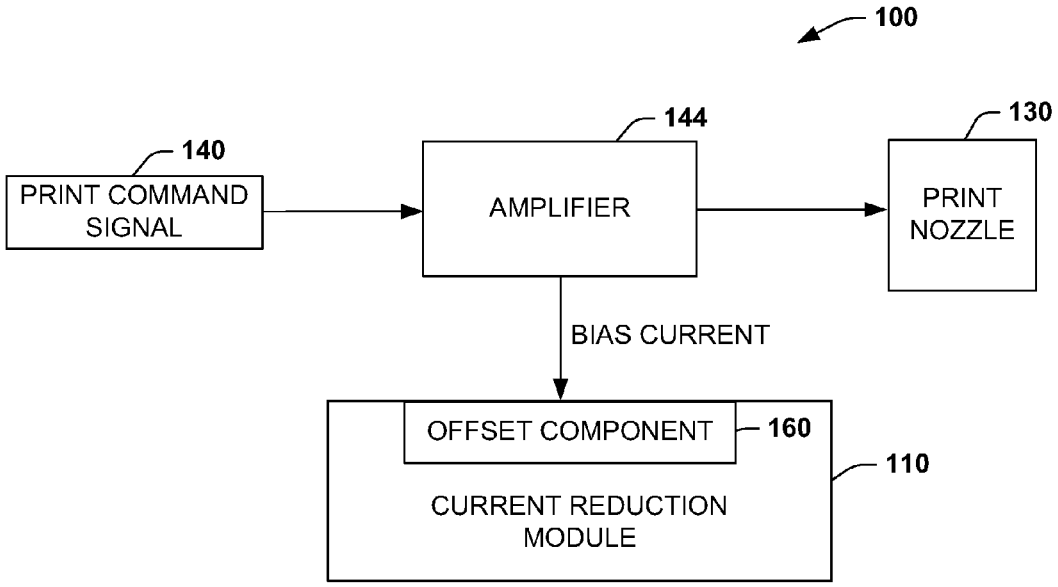
FIG. 1 illustrates an example apparatus that utilizes a current reduction module to mitigate power in circuits that drive a print nozzle.

FIG. 1 illustrates an example apparatus 100 that utilizes a current reduction module 110 to mitigate power in circuits that drive a print nozzle 130. As shown, a print command signal 140 (e.g., voltage signal that commands ink to be dispensed from the print nozzle) can be applied to an input of an amplifier 144 having gain control feedback that amplifies the signal to drive the print nozzle 130. The amplifier 144 can include one or more multiple amplifier stages to drive the print nozzle 130. This can also include a pass gate (not shown) that receives output from the amplifier 144 to drive the print nozzle 130. The current reduction module 110 receives bias current from the amplifier 144 and reduces such bias current from being passed on to a subsequent amplifier stage via an offset component 160. The offset component 160 can divert the bias current from reaching subsequent amplification stages associated with the amplifier 144. By reducing the bias current, power in the subsequent amplifier stages can be mitigated. In general, the bias current is utilized by the amplifier 144 for normal quiescent operations of the amplifier. Such bias current does not serve the signal driving needs of the print command signal 140 however. As such, if the bias current can be reduced from being passed along with the print driving signal, power in subsequent stages can be reduced since the bias current has been removed and is not multiplied by the higher voltages employed in subsequent amplifier stages. As used herein the term reduce refers to reducing a portion or substantially all of the bias current.

The amplifier 144 can be operated in class A-B mode to drive the print nozzle 130. Class A, class A-B, or class B amplifiers can be employed in a single or a multiple stage configuration to generate print command signals. Multiple stage operation can also be provided for the amplifier 144 wherein one stage could be configured as class A, A-B, or class B and a subsequent stage (or subsequent stages) could be configured as class A, A-B or class B, for example. The reduced power savings can be further enhanced since there can be hundreds of print nozzles 130—each requiring their own amplifier 144 to command ink dispersal from the respective print nozzles.

In one example, the amplifier 144 can be employed as a first stage amplifier to drive a second stage amplifier (illustrated in FIG. 3) that drives the print nozzle 130. In another example, the amplifier 144 can be employed as a first stage amplifier to drive multiple amplifier stages that drive the print nozzle 130. In yet another example, the amplifier 144 can be configured as a multiple stage amplifier having a class A-B configuration for one stage and a class B configuration for a second stage. Each stage of the multiple stage amplifiers can have a separate current reduction module 110 to mitigate bias current in each stage. In one example, the current reduction module 110 can employ fixed transistor circuits to offset the bias current. In another example, the current reduction module can employ a current reduction digital to analog converter (DAC) to offset the bias current.

A control circuit (not shown) can be provided that utilizes a firmware value to determine an amount of offset applied to the DAC to reduce the bias current from appearing at a subsequent stage. In one example, the firmware stores multiple values that represent different offsets to reduce the bias current from appearing at a subsequent stage. In another example, the multiple values can be correlated to a temperature profile, wherein differing temperatures in the temperature profile are assigned to different offsets to reduce the bias current from appearing at a subsequent stage. For example, during manufacturing, temperature tests can be conducted where it a suitable amount of offset and associated DAC setting is determined that can be saved in firmware for the respective temperature setting. At a different temperature setting, bias current can be monitored at the different temperature level and a different offset and associated DAC setting can be saved in firmware. Depending on the temperature of operation for a printer for example, a suitable setting can be selected during printer installation or some other time.

For purposes of simplification of explanation, in the present example, different components of the systems described herein are illustrated and described as performing different functions. However, one of ordinary skill in the art will understand and appreciate that the functions of the described components can be performed by different components, and the functionality of several components can be combined and executed on a single component or be further distributed across more components. The components can be implemented, for example, as an integrated circuit or as discrete components, or as a combination of both. In other examples, the components could be distributed among different printed circuit boards, for example.

Figure 2:
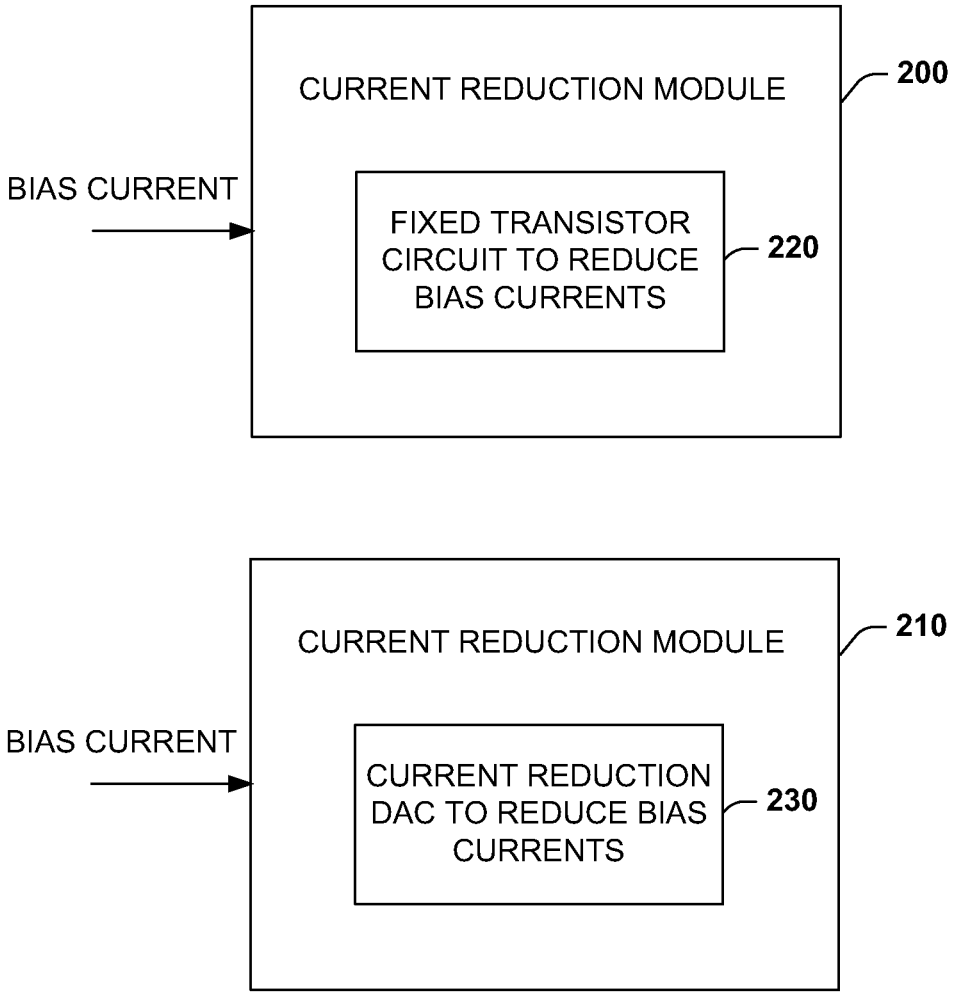
FIG. 2 illustrates examples of a current reduction module to mitigate power in circuits that drive a print nozzle.

FIG. 2 illustrates examples of a current reduction module 200 and 210 to mitigate power in circuits that drive a print nozzle. As shown, current reduction module 210 includes a fixed transistor circuit 220 to reduce bias current from reaching a subsequent stage of amplification. Such fixed transistor circuits can be preconfigured to divert a predetermined amount of bias current from reaching a subsequent amplifier stage. Thus, measurements of bias current can be taken during production to determine a level of current for a given amplifier configuration and temperature. Based on such measurements, gain resistances in the fixed transistor circuits can be set (e.g., laser etching to set resistance value in semiconductor) to control a predetermined amount of bias current in which to offset and ultimately divert from reaching a subsequent amplification stage.

In another example of current reduction, a current reduction digital to analog convertor (DAC) 230 can be employed in the current reduction module 210 to reduce bias currents from reaching subsequent amplifier stages. The DAC 230 can be programmed with an amount of current in which to divert from the subsequent stage. Bias reduction profiles can be stored in firmware, where different values of offset can be saved for the respective DAC. Thus, in the case of a temperature profile for bias reduction, DAC offset settings could be saved for different temperatures. Such offsets could be determined during production where the amplifiers were exposed to different temperatures and their resultant bias currents could be measured. When the amplifiers reached their installed environment (e.g., when printer was installed), the base temperature setting could be passed along to the controller for the DAC and bias current reduction could be selected from the temperature profile settings based on the temperature of the installed environment. If the temperature were variable, control feedback could be employed to monitor the temperature and select different profile settings to reduce bias current based on the detected temperature, for example.

Figure 3:
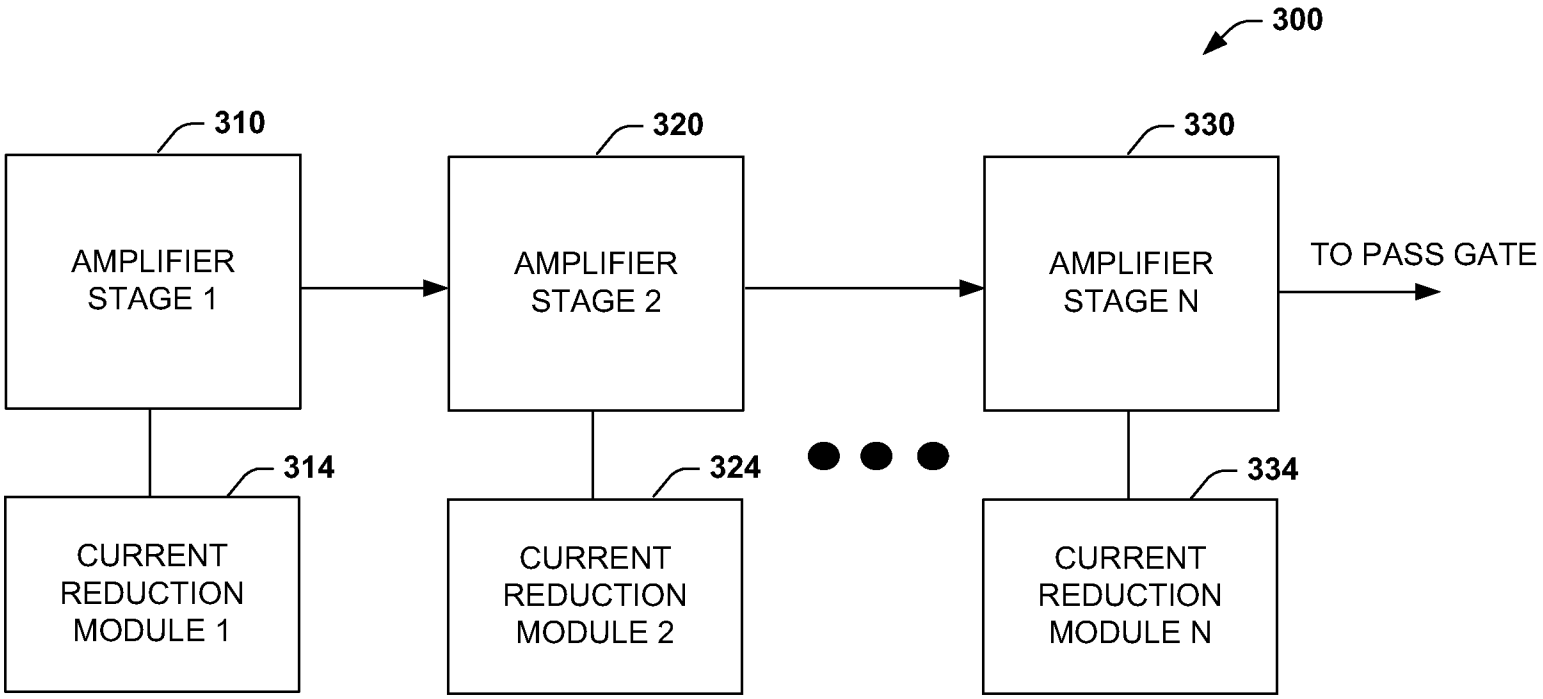
FIG. 3 illustrates an example multistage amplifier configuration that employs a current reduction module to mitigate power in circuits that drive a print nozzle.

FIG. 3 illustrates an example multistage amplifier configuration 300 that employs a current reduction module to mitigate power in circuits that drive a print nozzle. As shown, the multistage amplifier 300 can include a first amplifier stage 310 having current reduction module 314, a second amplifier stage 320 having a second current reduction module 324, followed by an Nth amplifier stage 330 having a current reduction module 334, wherein N represents a positive integer. In one example configuration of the multistage amplifier 300, a two-stage amplifier can be employed to drive a print nozzle. For example, a first stage can be configured as a class A-B amplifier and a second stage can be configured as a class B amplifier. Each stage however can be configured as class A, class B, or class A-B. Also, each stage of the multistage amplifier 300 may or may not employ a current reduction module. For example, a first stage may employ a current reduction module and all subsequent stages do not. Various combinations of amplifier classes, classes utilizing bias current reduction, and classes without bias current reduction can be employed. Also, the current reduction modules can include combinations of fixed transistor implementations or DAC current reduction methods described herein.

Figure 4:
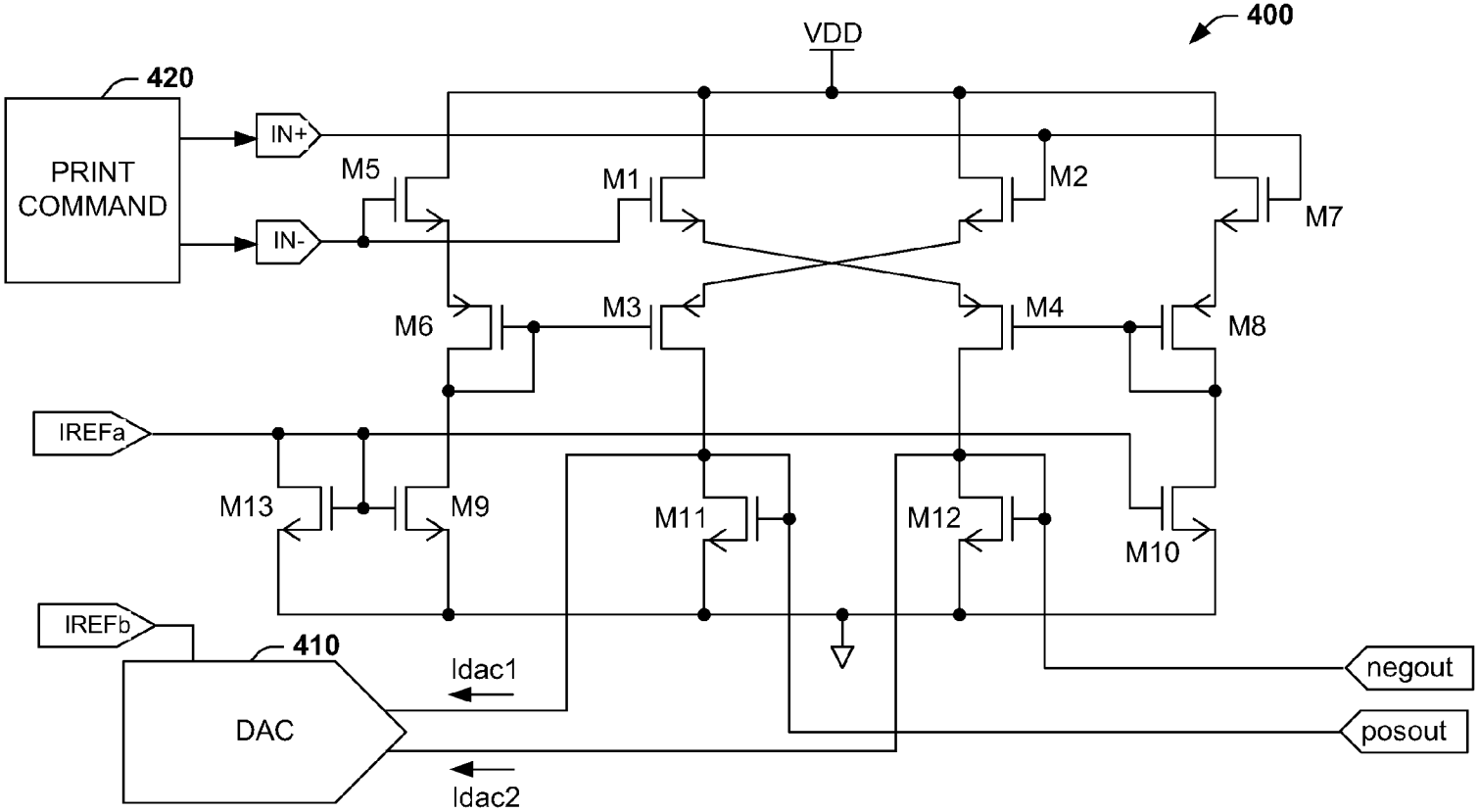
FIG. 4 illustrates an example amplifier circuit that employs a current reduction digital to analog converter (DAC) to mitigate power in circuits that drive a print nozzle.

FIG. 4 illustrates an example amplifier circuit 400 that employs a bias adjuster to mitigate power and improve switching performance in circuits that drive a print nozzle. The circuit 400 can operate in class AB amplifier mode and can be employed to drive a subsequent amplifier stage that in one example operates in class B mode. The circuit 400 typically operates as a first stage. For purposes of discussion only, assume currents Idac1 and Idac2 into the DAC 410 are initially set to zero. For further simplicity of discussion, assume that the NMOS transistors M1, M2, M5, M7, and M9-M13 are about the same physical dimensions and properties, and assume the same for the associated PMOS transistors, M3, M4, M6, and M8. A print command signal 420 is received by inputs marked as IN+ and IN− which are amplified by transistors M1, M2, M3, and M4, configured as a differential amplifier.

Transistors M1-5 and M7 can be configured as source followers, wherein M5 receives input IN− and M7 receives input IN+. Output voltage from the source follower M5 and M7 sets the source voltage of M6 and M8, respectively. The gate voltage of M6 and M8 can be set by the source voltage of M5 and M7 plus the diode connected voltages of M6 and M8. Transistor pairs M6, M3 and M8, M4 can be designed to be current mirrors and mirror quiescent current into M11 and M12, respectively. The current in the two side legs of the circuit, one side-leg circuit being formed of M9, M6, M5 and the other side-leg circuit being formed of M10, M8 and M7 are set by current mirror into M9 and M10, and hence are substantially constant. One purpose of these side legs is to set the gate voltages for M3 and M4, where if the effective voltage difference between IN+ and IN− is equal to zero, and the common mode voltage within normal operating range, then the current in the transistors M11 and M12 can be equal to each other. If the effective voltage difference between IN+ and IN− is greater than or less than zero, then there can be a corresponding increase in current in the M11 or M12 legs respectively, with a current magnitude that can increase to a value greater than the original quiescent value in M11 and M12.

Since the additional current in M11 and M12 can be provided by the source follower action of M1 and M2 versus M3 and M4, it can reach a large magnitude, substantially determined by the source impedances and allowable voltage ranges provided by these devices and generally not limited by the original quiescent current. In this manner, this first stage amplifier depicted by the circuit 400 provides class A-B operation, where there is a substantially constant base bias current when the effective voltage difference between IN+ and IN− is equal to zero, and then when an effective voltage difference between the IN+ and IN− inputs is introduced, such as when the circuit 400 is being commanded to slew, the inner leg of the circuit that is needed to effect the slew has a current on it that grows to a large value, greater than that of the initial, constant bias. The transistors M9, M10, and M13 also receive and process a reference current shown as IREFa to set the original quiescent current.

Transistors M11 and M12 can form a second current mirror that receives positive and negative output current from the differential amplifier at the drain leads of M3 and M4, respectively. The positive and negative output current fed to the current mirror formed from M11 and M12 include a bias current component and a variable current component that is a function of the voltage applied at IN+ and IN−. It is the bias current component that is fed to the current mirror of M11 and M12 that is offset by the current reduction DAC 410. As shown, the DAC 410 diverts bias currents Idac1 and Idac2, wherein the amount of current diverted is a function of the programmed value of the DAC that can be set from firmware settings via a controller (not shown) for example. A second reference, IREFb, can be supplied to the DAC 410.

Output from the amplifier 400 can be generated as negative and positive output signals and shown as signals negout and posout, respectively. In one example, negout and posout signals can be coupled to the gate of an NMOS transistor to form the second half of a mirror circuit in order to mirror the current output of this first stage into subsequent stages. Such output from the amplifier 400 can be employed to drive a subsequent amplifier stage (e.g., class B amplifier), wherein the subsequent stage is employed to control a level shifted stage that drives a piezo print nozzle amplifier, for example. As described above with respect to FIG. 3, a plurality of amplifier stages can be employed where all or a subset of the stages can employ the bias adjuster methods described herein. It is also possible to use alternate biasing methods with this first stage amplifier depicted as circuit 400, such as class B, where there is substantially no bias current until slewing occurs. In this case, there may be undesirable effects from this lack of quiescent current, and the DAC 410 may be operated in a manner to supply a minimum quiescent current, similar to that described above, but in opposite polarity of operation.

As noted above, width and length die dimensions can be adjusted to mitigate power losses and enhance switching performance in the circuit 400. For example (w=width and l=length, u means micron or micro), M9, M10 can be selected as w=3.75 u by l=1 u to mirror in a small current, about 2.74 uA, about half of IREFa to keep the current used in the outer legs of the circuit 400 (M9, 11 legs) to a minimum. This current is static, and hence causes power dissipation. In another example, M1, M2, M5, M7, NMOS dimensions can be selected as w=40 um and l=1 u. For M3, M4, M6, M8, PMOS dimensions can be selected as w=80 u, l=1 u, for example. Such W/l ratios selected provide enough gain for the amplifier, yet also provide approximately a 1000× increase in bias current when slewing (for an ideal, matched set of transistors). In practice, the bias current increase for slew can be smaller due to transistor mismatch, wherein several hundreds of times the base bias current is realized. In yet another example, M11, M12, dimensions can be selected w=40 u, l=1 u, wherein these dimensions provide a low impedance, as these are mirrored not only to the second stage of the amplifier for level shifting but also mirrored to the level shifter for the pass gate (if implemented), so width here is controlled because of capacitive loading on this set of mirrors, for example.

Figure 5:
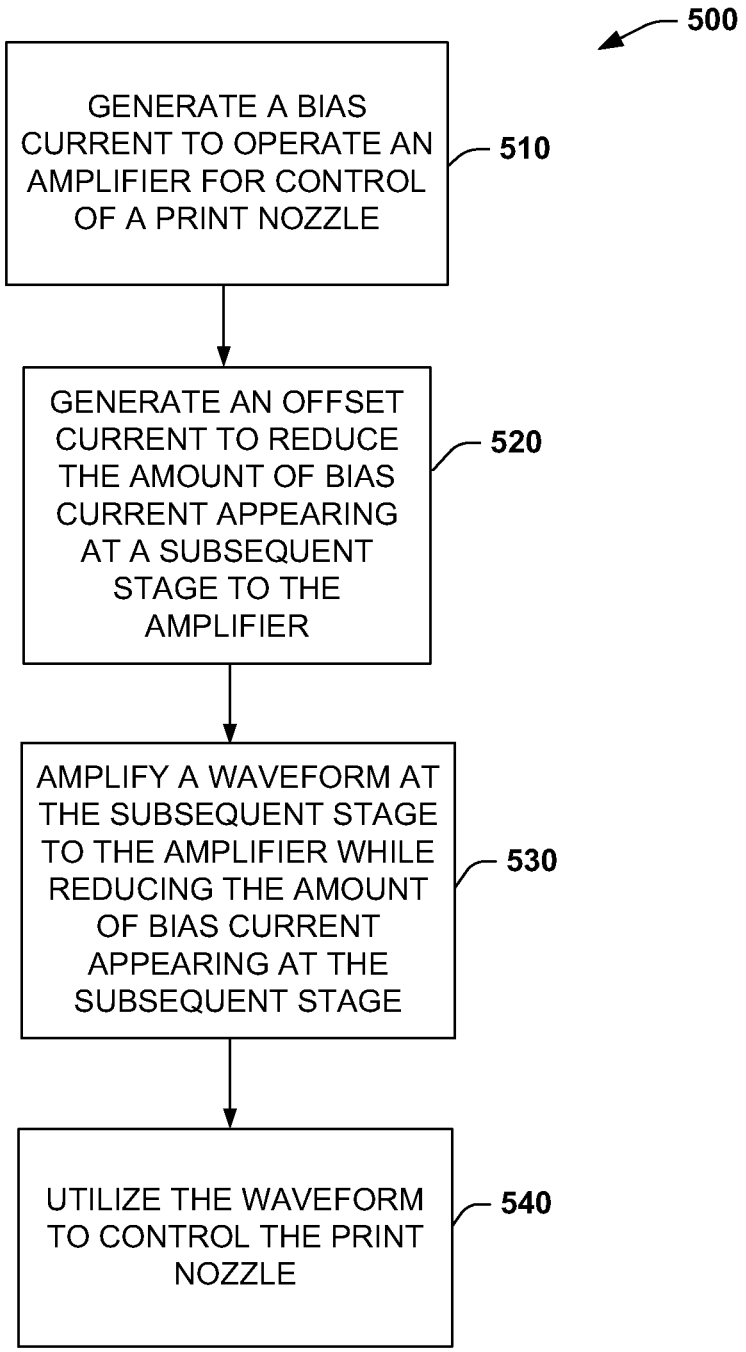
FIG. 5 illustrates an example method for mitigating power in circuits that drive a print nozzle.

In view of the foregoing structural and functional features described above, an example method will be better appreciated with reference to FIG. 5. While, for purposes of simplicity of explanation, the method is shown and described as executing serially, it is to be understood and appreciated that the method is not limited by the illustrated order, as parts of the method could occur in different orders and/or concurrently from that shown and described herein.

FIG. 5 illustrates an example method 500 for mitigating power in circuits that drive a print nozzle. The method 500 generates a bias current to operate an amplifier for control of a print nozzle at 510. Such bias currents are utilized by the operational amplifier during quiescent operations of the amplifier. It is desirable that such currents, although useful for operation of a given amplifier stage, are not passed on to a subsequent stage for amplification and undesirable power loss. At 520, the method 500 generates an offset current to reduce the amount of bias current appearing at a subsequent stage to the amplifier. At 530, the method 500 amplifies a waveform at the subsequent stage to the amplifier while reducing the amount of bias current appearing at the subsequent stage.

In one example, fixed transistor circuits can be preconfigured to divert a predetermined amount of bias current from reaching a subsequent amplifier stage. In another example, a digital to analog converter (DAC) can be programmed with an amount of current in which to divert from the subsequent stage. As noted previously, profiles can be stored in firmware, where different values of offset can be saved for the respective DAC. Thus, in the case of a temperature profile, DAC offset settings could be saved for different temperatures. Such offsets could be determined during production where the amplifiers were exposed to different temperatures and their resultant bias currents could be measured. When the amplifiers reached their installed environment (e.g., when printer was installed), the base temperature setting could be passed along to the controller for the DAC and bias current reduction could be selected from the temperature profile settings based on the temperature of the installed environment. At 540, the method 500 utilizes the waveform to control a print nozzle.

Figure 6:
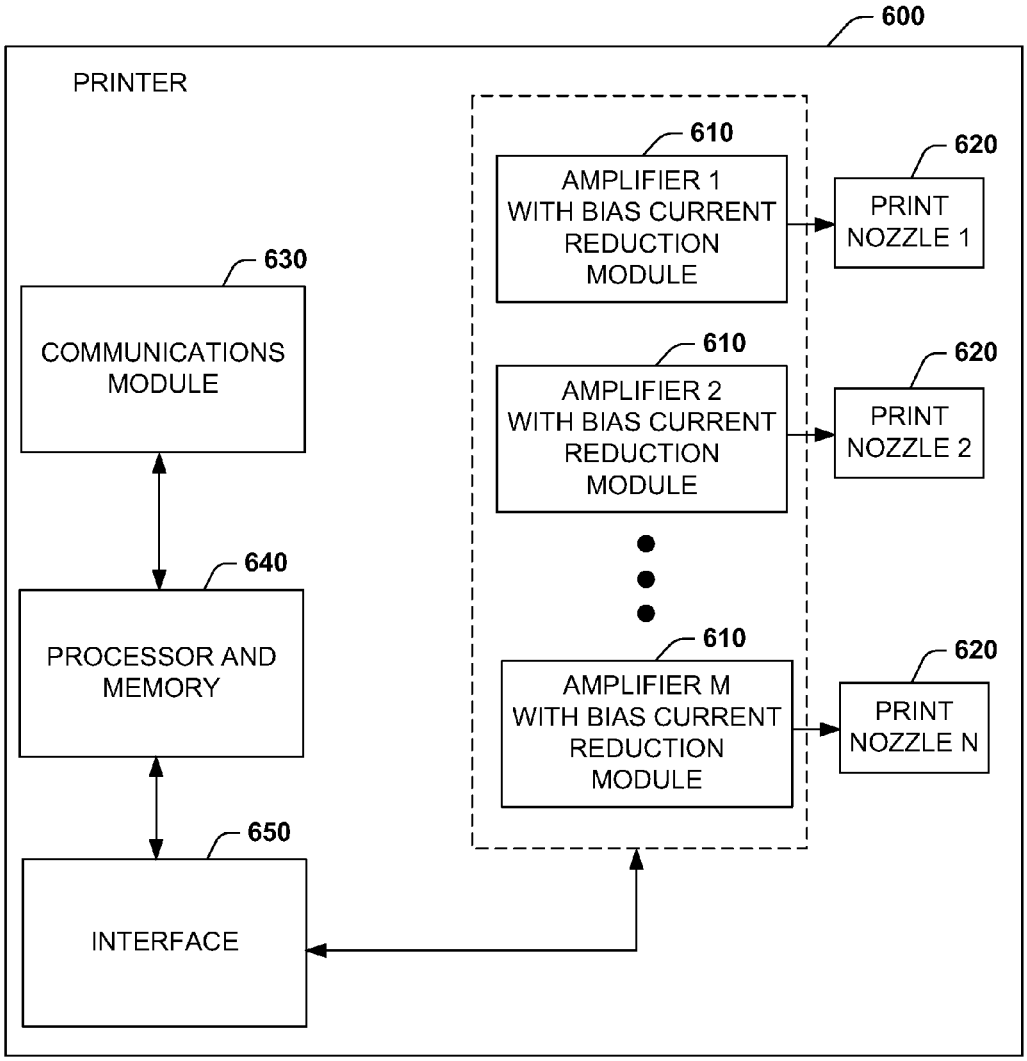
FIG. 6 illustrates an example printer that employs amplifiers utilizing bias current reduction modules to drive a plurality of print nozzles.

FIG. 6 illustrates an example printer 600 that employs amplifiers 610 utilizing bias current reduction modules to drive a plurality of print nozzles 620. The print nozzles 620 are shown as nozzles 1 through N, with N representing a positive integer. The respective print nozzles 620 are driven from a corresponding amplifier 610 shown as amplifiers 1 though M, with M representing a positive integer. Each of the respective amplifiers 610 employ bias current reduction modules as previously described. The printer 600 can also include a communications module 630 for receiving print commands and updating printer status. The communications module 630 can include local connections such as from a print cable and/or can include remote network connections such as can be received from a local network and/or over a public network such as the Internet, for example. The communications module 630 can be operated by a processor and memory module 640 which can include executable operating instructions to operate the printer 600. Such instructions can operate the method 500 described above with respect to FIG. 5, for example, to generate drive waveforms at the print nozzles 620 and operations in the amplifiers 610. The processor and memory module 640 can also connect to an interface module 650 that performs digital to analog conversions among other interface operations to control the amplifiers 610.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus, comprising:

an amplifier that employs a bias current to drive a print nozzle; and a current reduction module comprises at least two stages, each stage being employed to offset the bias current at the respective stage and to reduce the bias current from appearing in a subsequent stage of the amplifier in order to mitigate power in the subsequent stage, wherein the current reduction module employs a digital to analog converter (DAC) at a given stage of the at least two stages and employs a fixed transistor at another stage of the at least two stages.

2. The apparatus of claim 1, wherein the amplifier is configured as a multistage amplifier and each stage of the multiple stage amplifier has a separate current reduction module to mitigate bias current in each stage.

3. The apparatus of claim 1, wherein the current reduction module employs the fixed transistor circuit to divert a predetermined amount of bias current to offset the bias current at the subsequent stage.

4. The apparatus of claim 1, further comprising a control circuit that utilizes a firmware value to determine an amount of offset applied to the DAC to reduce the bias current from appearing at a subsequent stage.

5. The apparatus of claim 4, wherein the firmware stores multiple values that represent different offsets to reduce the bias current from appearing at a subsequent stage.

6. The apparatus of claim 5, wherein the multiple values are correlated to a temperature profile, wherein differing temperatures in the temperature profile are assigned to different offsets to reduce the bias current from appearing at a subsequent stage.

7. A printer, comprising:

a plurality of print nozzles;

a plurality of operational amplifiers to drive the print nozzles, wherein each of the plurality of operational amplifiers employ a current reduction module to reduce an amount of bias current based on a respective gain resistance set to control a predetermined amount of bias current from appearing at a subsequent stage of each of the plurality of operational amplifiers; and a processor and memory module to direct remote print commands to the operational amplifiers to drive the print nozzles.

8. The printer of claim 7, wherein the current reduction module employs a fixed transistor circuit or a current reduction digital to analog converter to reduce the amount of bias current from appearing at the subsequent stage to each of the plurality of operational amplifiers.

9. A method, comprising:

generating a bias current to operate an amplifier for control of a print nozzle;

employing control feedback to monitor a temperature of the amplifier and to select a profile setting to reduce bias current based on the temperature;

generating an offset current to reduce the amount of bias current appearing at a subsequent stage to the amplifier based on the selected profile setting;

amplifying a waveform at the subsequent stage to the amplifier while reducing the amount of bias current appearing at the subsequent stage; and utilizing the waveform to control the print nozzle.

* * * * *